United States Patent [19]

Landa

[11] 3,990,696

[45] Nov. 9, 1976

[54] FEEDING STATION

[75] Inventor: Benzion Landa, Ramat Hasharon, Israel

[73] Assignee: Imaging Technology Limited, Stanmore, England

[22] Filed: June 17, 1975

[21] Appl. No.: 587,737

Related U.S. Application Data

[63] Continuation-in-part of Ser. No. 371,391, June 19, 1973, abandoned.

[30] Foreign Application Priority Data

June 19, 1972 United Kingdom ..... 28663/72

[52] U.S. Cl. ..... 271/94; 271/98; 271/103; 271/DIG. 3

[51] Int. Cl.[2] ..... B65H 3/10

[58] Field of Search ..... 271/94, 95, 96, 97, 271/98, 103, 105, 108, 30 R, 18.1, DIG. 3, 196

[56] References Cited

UNITED STATES PATENTS

| | | | |
|---|---|---|---|
| 256,047 | 4/1882 | Randall | 271/196 X |
| 1,707,209 | 3/1929 | Broadmeyer | 271/96 |
| 2,837,333 | 6/1958 | Sindzinski et al. | 271/96 UX |
| 3,351,340 | 11/1967 | Levine | 271/DIG. 3 |
| 3,595,563 | 7/1971 | Rostoker et al. | 271/98 X |
| 3,637,201 | 1/1972 | Schrempp et al. | 271/94 |

*Primary Examiner*—John J. Love
*Assistant Examiner*—Bruce H. Stoner, Jr.
*Attorney, Agent, or Firm*—Michael J. Striker

[57] ABSTRACT

The invention relates to a sheet feeding station for a magazine in which a plurality of individual sheets are located one against another, with a pneumatic pick-up roller rotatably mounted adjacent to the magazine and at that end of the magazine from which the sheets are destined to leave the magazine. The invention is characterized in that the roller is stationary in a precisely defined rest position at the start of a sheet-feeding feeding operation and remains in this rest position until it is sensed that a sheet is held against it by air pressure, the roller then rotating to feed the sheet so held, and continuing to rotate until the sheet-feeding operation has been completed.

9 Claims, 4 Drawing Figures

FEEDING STATION

Figure 1:
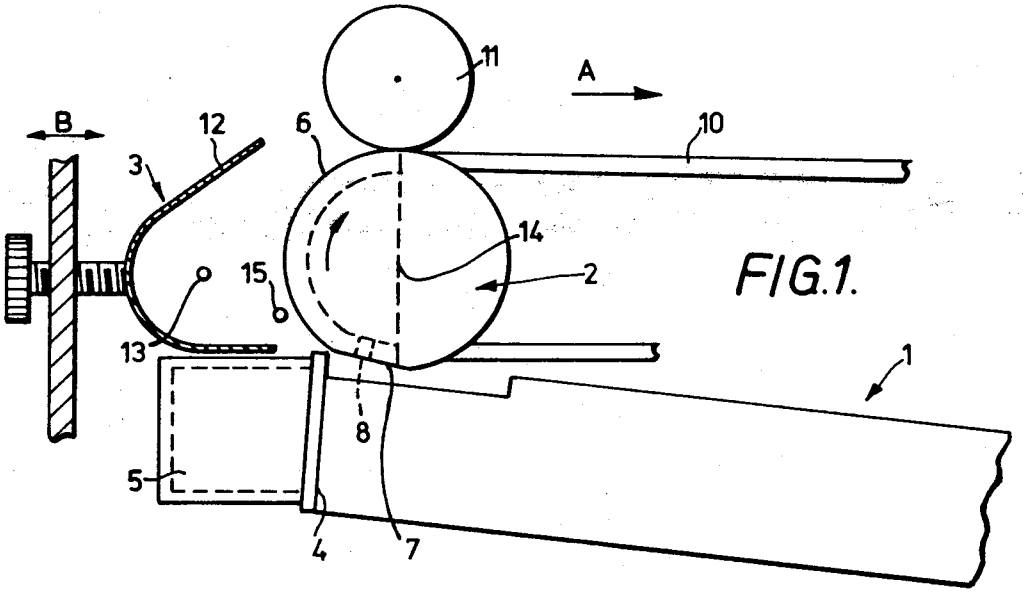

This application is a continuation-in-part of application Ser. No. 371,391, filed June 19, 1973, now abandoned.

This invention relates to an improved sheet feeding station which has application to a wide range of processing machines in which individual sheets have to be fed, one at a time, from a magazine containing a stack of such sheets.

The invention has particular, but not exclusive, application to electrophotographic machines and may form a combined sheet feeding/electrostatic charging station for such a machine.

It has been proposed to employ a sheet feeding apparatus having a rotating pick-up roller with a line of air openings in its surface and mounted above a sheet magazine. The interior of the roller is connected to the inlet of an air blower to draw air through the openings, and the outlet of the blower feeds the air drawn from the interior of the roller into the magazine, to pass around the edges of the sheets in a stack and expand the stack until the uppermost sheet can be sucked against the pick-up roller thereby closing the openings therein. The described arrangement is stated to ensure the feeding of only single sheets but suffers from the disadvantage that the moment at which a sheet is fed from the magazine cannot be determined with any certainty since it depends on (a) when the uppermost sheet is close enough to the roller to be attracted to it and (b) when the line of air openings on the rotating roller surface is directly over the surface of the uppermost sheet.

The present invention seeks to provide an improved sheet feeding station employing a pneumatic pick-up roller in which precise feeding of single sheets occurs, with each sheet fed being registered precisely relative to the position of the pick-up roller.

According to this invention a sheet feeding station comprises a walled magazine having an upper edge and adapted to contain a stack of sheets resting upon each other and each having a leading edge; pick-up menas mounted adjacent to said upper edge of said magazine and having an elongated sheet contacting surface extending in the direction of the leading edge of the uppermost of the sheets and being provided in said contacting surface with air inlet means; air outlet means in a wall of said magazine; means for drawing air through said air inlet means in said pick-up means and for expelling the air through said air outlet means in the magazine so that the leading edge portion of the uppermost sheet of the stack is lifted up towards said pick-up means and then held against the surface of said pick-up means to cover said air inlet means and thereby create a reduction of air pressure in the interior of said pick-up means; drive means for moving said pick-up means relative to said magazine to move the uppermost sheet of the stack thus held against said air inlet means; sensing means sensing the reduction of air pressure in the interior of said pick-up means when a sheet is thus held and for starting operation of said drive means each time the air pressure in the interior of said pick-up means is reduced by the leading edge portion of the uppermost sheet covering said air inlet means; and means for terminating operation of said drive means at the completion of a single sheet feeding operation.

Suitably a sensing of the pressure in the duct is utilised to determine when a sheet is held against the roller, the degree of pressure reduction becoming marked only if the leading edge of a sheet is obturating the air inlet means in the roller.

Preferably the pick-up means is a roller and a line of air openings in the roller is provided on a flattened region to define the air inlet means, this region being inclined away from a plane parallel to rest planes of sheets in the magazine when the roller is in its rest position prior to a sheet-feeding operation. In this way, when the leading edge of the sheet to be dispensed is drawn into contact with the flattened region, it is flexed away from any adhering sheet at the leading edges, ensuring that as the roller rotates only the attached sheet is drawn from the magazine, the adjacent sheet whose leading edge is not so flexed being left in the magazine.

Air pressure is used to expand the stack of sheets in the magazine prior to a sheet feeding operation. One very convenient arrangement for achieving this involves supplying air drawn from the interior of a pick-up roller to a triangular array of air outlets formed in the end wall of the magazine adjacent to the leading edges of the sheets.

Suitably the pick-up roller is grooved to locate spacedapart endless flexible bands, which bands define a conveying surface on which the attached sheet can be further conveyed after it has been released from the pick-up roller.

Figure 2:
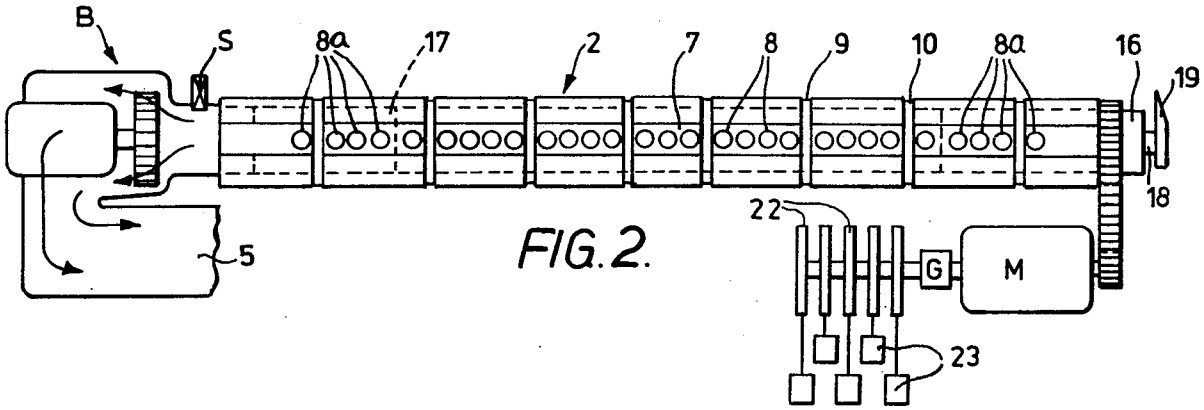
Figure 4:
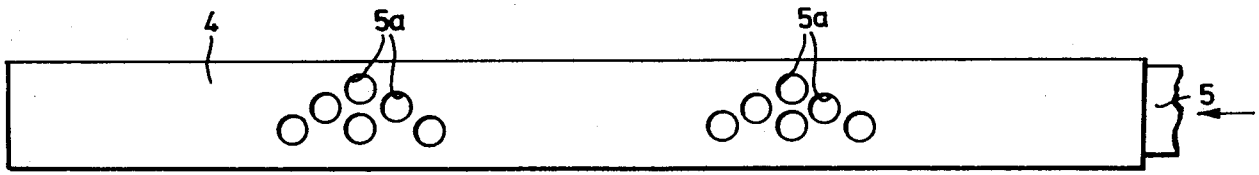
Figure 3:
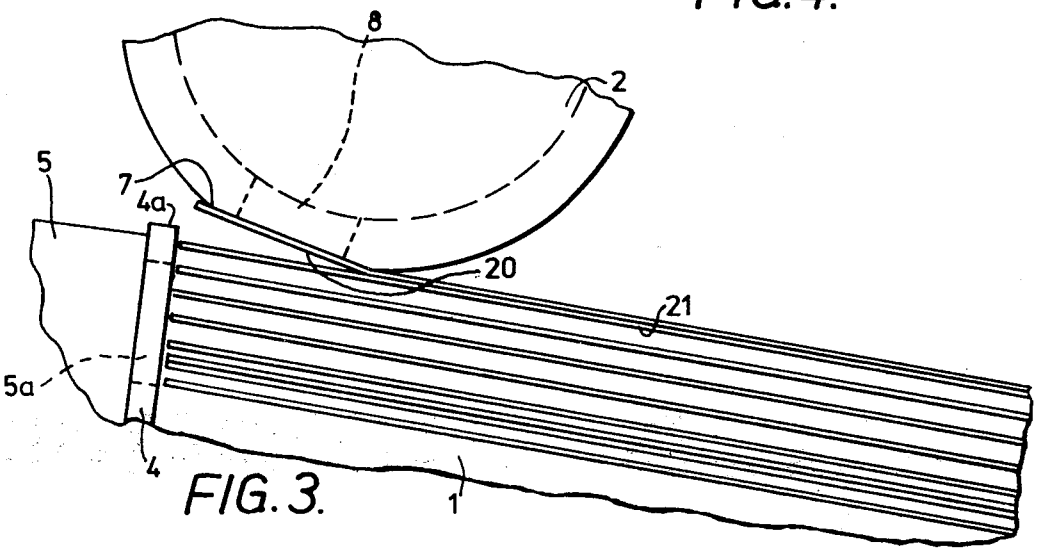

The invention will now be described, by way of example, with reference to the accompanying drawings, in which:

FIG. 1 is a schematic side elevation of a combined sheet feeding/electrostatic charging station for an electrophotographic copying machine, FIG. 2 is a front elevation of the pick-up roller of the station shown in FIG. 1, FIG. 3 is an enlarged view of part of the pick-up roller showing how a sheet is attached thereto, and FIG. 4 is a view of the front end of the sheet magazine of the station of FIG. 1.

The sheet feeding/charging station shown in FIG. 1 comprises a paper magazine 1, a rotatable pick-up roller 2 and a corona discharge member generally designated 3.

A stack of sheets for use in the electrophotographic machine (e.g. zinc oxide coated paper sheets) is placed in the magazine, coated side down, with an edge (hereinafter called the "leading edge") of each sheet in contact with an end plate 4 of the magazine 1, the leading edges then being disposed below the rotating pick-up roller 2. An air supply pipe 5 is attached to the end plate 4, the interior of the pipe communicating with arrays of openings 5*a* (see FIG. 4) in the end plate 4, which openings define two triangular arrays situated symmetrically with reference to the width of the magazine 1, the apex of each array extending close to the top of the end plate 4 and the base of which is close to the bottom of the magazine. Air blown into the pipe 5 is thus forced to issue through the openings 5*a* in the end plate and can only escape from the magazine by passing between the sheets located in the magazine, thereby causing the thickness of the stack of sheets to increase to the full height of the triangular arrays of openings 5*a* as sheets are separated one from another by the air forced into the stack of sheets.

Using a triangular array of openings 5*a* in the manner shown in FIG. 4 ensures:- a. that the top sheet is always close to the roller after the stack has expanded, and b. that when the number of sheets in the stack is on the low side, then air is still being blown into the stack (from the base of the triangle) rather than over it. The stack will therefore expand. Moreover in these circumstances the uppermost hole will probably be above the static stack so that the air which escapes through this hole (and which, initially, does not contribute towards expanding the stack) is only a small percentage of the total volume of air. Therefore the stack will still expand quickly. The pick-up roller comprises a metal tube 6 having a flat portion 7 formed on its peripheral surface, the flat portion being provided with a line of air openings 8. An air blower B (see FIG. 2 ) has its inlet connected to the interior of the tube 6 and its outlet connected to the pipe 5. When operating, the blowing B removes air from the hollow tube 6 and feeds it to the pipe 5. The tube 6 is provided with external grooves 9 at intervals spaced along its length, and in these grooves flexible endless bands 10 are located, the bands defining a conveyor for transporting sheets away from the pick-up roller 2 in the direction of the arrow A (see FIG. 1), after the sheets have been removed one-by-one from the magazine 1 by the roller 2. The cross-section of each band is small enough to enable it to be wholly contained within the groove 9, thus ensuring that the band does not contact the back of a sheet when the sheet is being transported by the roller 2 past the charging station 3. A co-operating pressure roll 11 is mounted above the pick-up roller 2, each sheet being made to pass through the nip between the roller 2 and the roll 11 prior to its being supported on the spaced-apart bands 10.

The corona discharge member 3 comprises an open-fronted electrically conducting housing 12 supporting a wire 13, the wire extending parallel to the axis of the roller 2 roughly on a level with the axis of the roller. The wire 13 is connected to a suitably high voltage source (not shown). The housing 12 is movably mounted in the frame of the machine and can be adjusted in the directions of the arrow B towards and away from the surface of the adjacent pick-up roller 2.

An internal structure is provided within the tube 6 to screen the openings 8 from the low pressure existing in the interior of the tube 6 when these openings lie to the right of the line 14 shown in FIG. 1. Only while the openings 8 are disposed to the left of the dotted line 14 can air flow inwardly through the openings 8 and the pneumatic pick-up arrangement be effective.

The station shown in the drawings operates in the following way:-

It will be assumed that the roller 2 is in the position shown in FIGS. 1 and 3, this being the rest position prior to a sheet feeding operation and the position to which the roller returns after each single sheet feeding operation. It will be noted that the flat portion 7 is inclined upwardly relative to the rest planes of sheets resting in the magazine 1 and the lowermost edge of the portion 7 and below the top edge 4*a* of the end plate 4 of the magazine 1. In this position, the openings 8 lie to the left of the dotted line 14. When sheet feeding is required the air blower is started thus drawing air through the openings 8, and expelling air through the openings 5*a* causing the top sheet in the magazine 1 to be raised up towards the stationary roller 2. The air currents flowing into the roller 2 through the openings 8 cause the leading edge of the top sheet to be up as it is sucked against the flat portion 7 to effectively seal all the openings 8. As soon as this happens there is sudden drop in the air pressure within the tube 6 and this drop in pressure is employed, via a pressure-sensitive electrical switch S, to energise a motor M (see FIG. 2) forming part of the drive system for the rotation of the roller 2. The motor M, via a gear box G, also serves to rotate a series of cam plates 22 which cooperate with microswitches 23 and act to control the sequential operations of various parts of the copying machine. Since the leading edge of the top sheet 20 (see FIG. 3) is now firmly attached to the roller 2 it is drawn away from the magazine 1 as the roller commences a single rotation in the clockwise direction as viewed in FIGS. 1 and 3. The second sheet 21 in the magazine is not flexed at its leading edge like the top sheet 20, so that it cannot follow the top sheet out of the magazine 1, it being trapped in the magazine by the end plate 4.

The top sheet is tensioned as it leaves the magazine as a consequence of its natural resistance to flexing and it is snugly pressed against the curved surface of the roller 2 as the latter conveys the sheet through the electrostatic field generated by the high voltage wire (the HT being applied to the wire 13 subsequent upon the operation of one of the cam plates 22 and cooperating microswitches 23). The coated surface of the sheet is facing the discharge member 3 and since the rear surface of the sheet is firmly pressed against the electrically conducting surface of the roller 2, a uniform charge is deposited on the sheet as it is being fed away from the magazine 1. By the time the openings 8 pass the dotted line 14 (from left to right) the sheet is engaged in the nip between the roller 2 and the roll 11 so that the masking of the openings 8 from the effect of the reduced pressure within the tube 6 does not result in release of the sheet from the positive drive which is acting to remove it from the magazine. In order to prevent the trailing end of the paper "flicking " out and contacting the wire 13, an insulating string 15 (e.g. of nylon) can be located in the position shown in FIG. 1.

The motor M continues to rotate (ignoring a cam-actuated lull for exposure of the print), until stopped by coaction between one of the cam plates 22 and the corresponding microswitch 23 deprives it of energising current at the end of a single sheet feeding operation. In the embodiment described and illustrated this will be after nine full 360° rotations of the roller 6 from its rest position. It will be appreciated that more, or less, than nine full rotations may be employed for each sheet-feeding operation depending on the geometry of the machine. In the embodiment shown, the cam plates 22 rotate through just 360° for each sheet-feeding operation, the gear-box G being chosen (or adjusted) to ensure the appropriate step-down ratio.

An alternative arrangememt to the string 15 is to dimension the circumference of the roller 2, relative to the length of the sheets to be conveyed, so that as the trailing edge of the sheet leaves the magazine it is overlying the openings 8 and is thus secured to the roller surface by air pressure. If desired the roller 2 may be provided with a further line of air openings to facilitate this securement of the trailing edge.

If the openings 8 are not totally obstructed by a sheet when those openings are disposed on the left-hand side of the dotted line 14, the reduction in pressure in the interior of the tube 6 will not be sufficient to actuate the switch S and rotation of the roller will not occur. Failure to pull down to a sufficiently low pressure in the tube 6 within a preset time from turning on the blower B can be used to indicate an "abnormal" condition (i.e. an empty magazine or a defective or deformed sheet at the top of the stack) and stop the machine.

Since the pipe 5 receives its air supply via the interior of the tube 6, the air supply to the magazine will be intermittent and this will have the effect of periodically expanding and collapsing the stack of sheets in the magazine 1, ensuring the stack "fills" the magazine each time prior to a sheet being removed.

The bands 10 can be as long as is desired and the region downstream of the roller 2 can serve as the "exposure station" of the machine. A particular advantage of the station described is that since the roller is stationary in a precisely defined rest position until pick-up of a sheet has occurred, the leading edge of the sheet 20 is very precisely located on the roller 2. Subsequent positions of the leading edge (e.g. as it enters the exposure station) can be accurately determined from the total angular displacement of the roller 2 from its starting position.

In order to obtain the required drop in pressure on correct sheet pick-up, it is necessary that the entire line of holes 8 be obstructed by the sheet being conveyed and if the machine is to be used with sheets of different widths, it is desirable to be able to blank off those openings 8 which are not required when a paper width less than the widest is being used. FIG. 2 shows one method in which this can be done. The openings 8 in the central portion of the roller 2 are always available while openings 8*a* in the two outer portions can be blanked off by means of rotatable valve tubes 16 and 17 which are linked together by means of a central rod 18 attached to a selector lever 19. The lever 19 can be set in two positions, in one of which the openings 8*a* are blanked off by the tubes 16 and 17 and in the other of which, the openings 8*a* are in communication with the reduced pressure generated within the interior of the tube 6. Clearly a modified arrangement can be provided if a range of different sheet widths are to be accommodated in the machine.

The use of internal valving within the tube 6 to isolate the openings 8 from the air blower may be avoided, by turning the blower off (e.g. by using one of the cam plates 22) or disconnecting it from the duct, at a suitable point in the rotation of the roller 2 such as to ensure the suction remains until, but only until, the leading edge of the sheet 20 is caught between the roll 11 and the roller 2.

The rest planes of the sheets in the magazine shown in the drawings are almost horizontal with the pick-up roller located above the stack. This arrangement is preferred since gravity aids in the collapse of the stack when the air flow through the openings 5*a* ceases. However arrangements in which the rest planes of the sheets are inclined steeply to the horizontal (even vertical) or in which the roller 2 is below the stack are not ruled out.

One particular advantage of the specific equipment illustrated is that it is very quiet in operation. Using a centrifugal air blower and switching the blower off when the pressure switch indicates that the leading edge of a sheet is secured over the openings 8, it is found that only a pulse of short duration is necessary to generate an adequate vacuum in the tube 6 to hold the sheet until its leading edge is caught between the roller 11 and the roller 2. This means that the blower operates for just a few seconds (at most) for each sheet-feeding operation.

The means for sensing when a sheet is held by the pick-up roller could be associated with the air blower or pump. Thus it could be a current sensing device associated with an electric motor energising the blower or pump, the sensing device detecting when the load on the motor reaches a pre-set value (corresponding to a pre-set pressure in the tube 6). Alternatively, a torque sensing device in the air pump drive could serve a similar purpose.

The charging station 3, by virture of the fact that it charges each sheet as it is supported against a cylindrical conducting surface whose axis is parallel to the wire 13, gives a very uniform charge intensity over the surface of the paper sheets. Using the suction roller as a part of the charging station gives rise to a very compact unit.

There may be advantages in feeding a limited amount of air to the housing 12 of the corona discharge member 3, either continuously, or at frequent periodic intervals. Stagnant air conditions within a corona discharge member do tend to adversely affect performance and the amount of air required for purging the corona discharge member is not great. The air supply can be drawn from any convenient source (e.g. the blower or pump used for the feeding station).

What is claimed is:

1. A sheet feeding station comprising a walled magazine having an upper edge and adapted to contain a stack of sheets resting upon each other and each having a leading edge; pick-up means mounted adjacent to said upper edge of said magazine and having an elongated sheet contacting surface extending in the direction of the leading edge of the uppermost of the sheets and being provided in said contacting surface with air inlet means; air outlet means in a wall of said magazine; means for drawing air through said air inlet means in said pick-up means and for expelling the air through said air outlet means in the magazine so that the leading edge portion of the uppermost sheet of the stack is lifted up towards said pick-up means and then held against the surface of said pick-up means to cover said air inlet means and thereby create a reduction of air pressure in the interior of said pick-up means; drive means for moving said pick-up means relative to said magazine to move the uppermost sheet of the stack thus held against said air inlet means; sensing means sensing the reduction of air pressure in the interior of said pick-up means when a sheet is thus held and for starting operation of said drive means each time the air pressure in the interior of said pick-up means is reduced by the leading edge portion of the uppermost sheet covering said air inlet means; and means for terminating operation of said drive means at the completion of a single sheet feeding operation.

2. A sheet feeding station as claimed in claim 1, wherein said pick-up means is a roller and the air inlet means is a line of air openings formed in a flat portion of the roller which flat portion is inclined away from a plane parallel to the rest planes of sheets in the magazine when the roller is in its stationary position prior to the sheet pick-up.

3. A sheet feeding station as claimed in claim 1, in which the air outlet means in the magazine form a generally triangular array in the front wall of the magazine with the apex of the array close to the upper edge of the magazine.

4. A sheet feeding station as defined in claim 1, wherein said sensing means control the movement of said pick-up means in dependence on the air pressure in the interior of said pick-up means.

5. A sheet feeding station as defined in claim 1, wherein the means for drawing air through said air inlet means and expelling the air through said air outlet means comprises a blower having an outlet communicating with said air outlet means in said magazine and an inlet communicating with said air inlet means in said pick-up means.

6. A sheet feeding station as defined in claim 5, wherein said pick-up means has a flat surface portion which is inclined away from a plane parallel from the planes of the sheets resting in the magazine when said pick-up means is in a stationary position prior to picking up a sheet, and wherein said air inlet means is a row of spaced air inlet openings in said flat surface portion.

7. A sheet feeding station comprising a magazine having an upper edge and being adapted to contain a stack of sheets each having a leading edge; a pick-up roller rotatably mounted adjacent the upper edge of the magazine and adjacent the leading edge of the uppermost of the sheets of the stack, said roller being provided in the peripheral surface thereof with air inlet means; blower means having an inlet and an outlet; a duct connecting said inlet of the blower means with said air inlet means of said roller so that air is sucked through said air inlet means and the leading edge portion of the uppermost sheet of the stack is firmly held onto the surface of the roller covering said air inlet means thereby creating a reduction of air pressure in said duct; drive means for rotating said roller; means for starting operation of said drive means each time the air pressure in said duct is reduced by the leading edge portion of the uppermost sheet of the stack being firmly held onto the surface of the roller covering said air inlet means; means for terminating operation of said drive means at the completion of a single sheet feeding operation; air outlet means opening into said magazine; and a second duct connecting said outlet of said blower means with said air outlet means in said magazine.

8. A sheet feeding station as defined in claim 7, wherein said roller is of electrically conductive material, and said station includes a charged wire substantially parallel to the axis of said roller and spaced from the surface thereof for electrically charging a sheet as it is withdrawn from said magazine.

9. A sheet feeding station as defined in claim 7, wherein said air inlet means are elongated in a direction parallel to the axis of rotation of said roller, and including means to block off part of said elongated air inlet means when feeding sheets of a width less than the maximum which can be fed by said roller.

* * * * *